US006969328B2

(12) United States Patent
Okamoto

(10) Patent No.: US 6,969,328 B2
(45) Date of Patent: Nov. 29, 2005

(54) SEQUENTIAL VIBRATION PREVENTER AND VIBRATION CONTROL STRUCTURE FOR BALL HITTING IMPLEMENT

(76) Inventor: Koji Okamoto, 9-3-910, Ujinamiyuki 1-chome, Minami-ku, Hiroshima-shi, Hiroshima 734-0015 (JP)

( * ) Notice: Subject to any disclaimer, the term of this patent is extended or adjusted under 35 U.S.C. 154(b) by 0 days.

(21) Appl. No.: 10/485,345

(22) PCT Filed: Jul. 25, 2002

(86) PCT No.: PCT/JP02/07571

§ 371 (c)(1),
(2), (4) Date: Jul. 29, 2004

(87) PCT Pub. No.: WO03/013665

PCT Pub. Date: Feb. 20, 2003

(65) Prior Publication Data

US 2005/0009649 A1 Jan. 13, 2005

(30) Foreign Application Priority Data

Aug. 3, 2001 (JP) ..... 2001-236234
Aug. 6, 2001 (JP) ..... 2001-005163

(51) Int. Cl.[7] ..... A63B 49/02
(52) U.S. Cl. ..... 473/521; 473/523
(58) Field of Search ..... 473/520, 521, 473/523, 519, 318, 300, 303, 553, 546, 549, 473/551

(56) References Cited

U.S. PATENT DOCUMENTS 4,693,474 A * 9/1987 Glaessgen et al. ..... 473/519
5,054,780 A * 10/1991 Chen ..... 473/519
5,277,423 A 1/1994 Artus
5,651,545 A * 7/1997 Nashif et al. ..... 473/520
5,728,008 A * 3/1998 Howard ..... 473/308
5,792,011 A * 8/1998 Kuebler ..... 473/520
5,797,812 A * 8/1998 Liu ..... 473/522
6,033,324 A * 3/2000 Nashif et al. ..... 473/520
6,042,485 A * 3/2000 Cheng ..... 473/318
6,234,920 B1 * 5/2001 Wang ..... 473/523

FOREIGN PATENT DOCUMENTS

JP 2-17154 2/1990
JP 4-18592 4/1992
JP 8-257170 10/1996

* cited by examiner

*Primary Examiner*—Raleigh W. Chiu
(74) *Attorney, Agent, or Firm*—Koda & Androlia

(57) ABSTRACT

A sequential vibration preventer for a ball hitting implement in which impact vibration that is generated when a ball is hit is transmitted to the human body from the impact generation source via the ball hitting implement. The sequential vibration preventer is detachably mounted on a portion of the implement where the vibration amplitude is large, such as the frame shaft or grip, so that the impact vibration is attenuated, and injury to the body is prevented. A ring body consisting of a soft material that has extendability or viscoelasticity is provided, and a plurality of vibrators are sequentially embedded in the circumferential direction in a single ring configuration or in a multiple ring configuration in the interior of the ring body. Alternatively, a belt body consisting of a soft material that has extendability or viscoelasticity or of a flexible material that is non-extendable, is provided, and a plurality of vibrators are embedded in the interior of the belt body so that these vibrators are sequentially disposed in one direction in a single row or in a multiple rows. A two-sided adhesive tape is disposed on either the outer surface or inner surface of the belt body.

9 Claims, 5 Drawing Sheets

SEQUENTIAL VIBRATION PREVENTER AND VIBRATION CONTROL STRUCTURE FOR BALL HITTING IMPLEMENT

TECHNICAL FIELD

The present invention relates to a sequential vibration preventer in a ball hitting implement, the term "ball hitting implement" referring to a ball hitting implement such as a tennis racquet, soft tennis racquet, squash racquet, badminton racquet, racquet ball racquet, golf club, baseball bat or the like. Here, the present invention will be described using mainly a tennis racquet as an example.

BACKGROUND ART

In a tennis racquet, the vibration of the impact when the ball is hit is transmitted to the frame from the gut plane (strings) and is further transmitted to the body of the player, i.e., wrist, elbow, etc., from the grip portion via the handle portion. If the body is frequently subjected to such impact vibration over a long period of time, cases of injuries such as peritendinitis and tennis elbow are commonly seen. From the incidence rate as well, this is viewed as a problem of sports injuries that cannot be ignored.

In the past, there have been vibration preventers that are mounted on the gut plane, bottom surface of the grip end or interior of the frame shaft in order to alleviate impact vibration of this type; however, no impact preventer that is detachably mounted on the outer circumferential portion of the frame shaft has been seen.

Typical vibrations that are the greatest in the frame shaft vibrations transmitted to the body when the ball is hit, and that have an effect on bodily injuries, include a two-node bending mode at approximately 120 Hz that is the fundamental mode characteristic of the frame shaft, as well as relatively higher-frequency vibrations such as a three-node bending mode at approximately 330 Hz, a two-node twisting mode at approximately 360 Hz, and a primary membrane vibrational mode of the strings at approximately 560 Hz. Besides these vibrations, there are numerous other vibrations up to high frequencies of approximately 2000 Hz, and it is known that respective characteristic non-vibrating parts or "nodes" are formed on the frame shaft in the main vibrational modes.

Here, the conditions of the "nodes" of the main vibrational modes are black and white boundary line portions as shown in FIG. 9 (cited from Yoshihiko Kawazoe: Rakketo no Kagaku [Racquet Science] II—: *Gekkan Tenisu Jaanaru* (Monthly Tennis Journal), 123, pp. 76–81 (1994.1)). The areas that are distant from these nodes are areas in which the vibration amplitude of the frame shaft is large, and are referred to as "bellies" of vibration. Especially in regard to the fundamental vibrational mode of the racquet, it has been found that the modes that make a large contribution to an unpleasant ball hitting sensation and injuries to the body are the two-node and three-node bending modes. Furthermore, it would appear that the mounting of vibration preventers in the areas forming the common "bellies" of both modes is an effective means of absorbing or attenuating vibration.

Furthermore, as is shown in FIG. 10, the respective implement portions that correspond to the racquet face portions (B1, B2, B3, B4), the front end portion (A) of the grip and the rear end (C) of the grip (in the vicinity of the grip end) constitute "bellies" where the vibration amplitude of the three-node bending mode that is generated in the case of relatively high-velocity center hitting is large. Accordingly, an improvement in the ball hitting sensation during center hitting would be expected when vibration preventers are mounted on these portions.

Furthermore, these implement portions are also common to the two-node bending mode that is generated mainly in low-velocity hitting and off-center hitting.

Accordingly, in light of the fact that the impact vibration caused by hitting of the ball is transmitted to the human body from the impact generating source via the frame shaft portion and handle portion, the present invention provides a sequential vibration preventer in which impact vibration is attenuated by mounting vibration preventers on the frame shaft that propagates such impact vibration, so that deleterious effects of such impact vibration on the body are prevented, and a grip vibration control structure using this sequential vibration preventer. The term "sequential vibration preventer" refers to a vibration preventer that has sequential or continuously lined up vibrators, and it is not a term indicating a special vibration mode for "sequential vibration."

DISCLOSURE OF INVENTION

The present invention is a sequential vibration preventer in which a ring body or belt body consisting of a soft material that has extendability or viscoelasticity has a plurality of sequential or continuously lined up vibrators and/or a plurality of rows of such vibrators. This sequential vibration preventer is devised so that the vibrators, which are comprised of a material with a high specific gravity, are surrounded by the soft material, so that the impact vibration that occurs during the hitting of the ball is absorbed or attenuated. When this vibration preventer is used, vibration can be prevented by mounting the preventer on parts that constitute "bellies" of vibration in the ball hitting implement.

Figure 1:
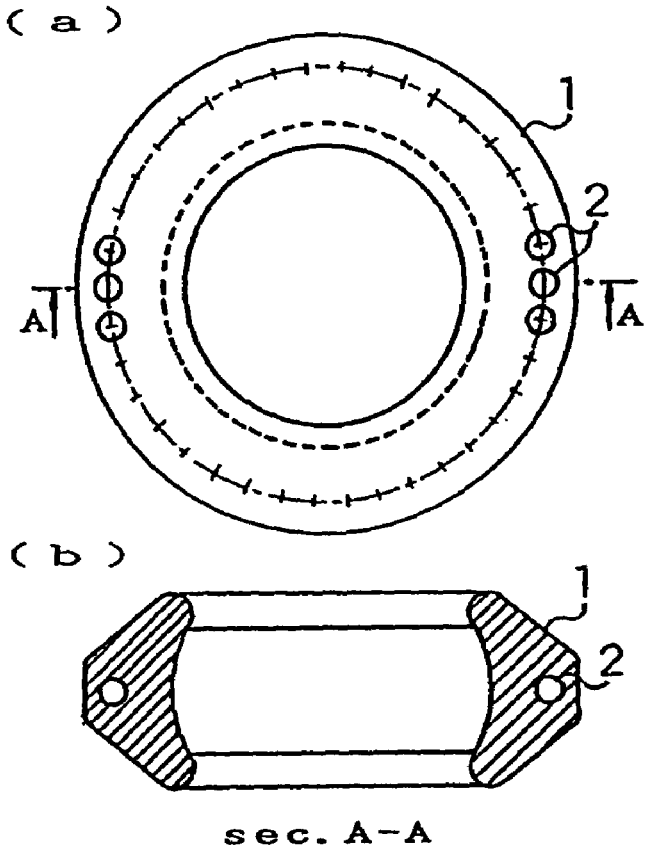
FIG. 1 illustrates an embodiment in which a ring body is formed, in which (a) is a front view and (b) is a central sectional view, respectively.

The symbols used in the Figures are listed and explained below.

1: Ring body

1': Belt body

2: Vibrators

3: Two-sided adhesive tape

4: Cut grooves

5: Cut slit

V: Grip (construction part)

W: Frame shaft (or club shaft)

X: Racquet

Y: Baseball bat

Z: Golf club

BEST MODE FOR CARRYING OUT THE INVENTION

In order to give a more detailed description of the present invention, the present invention will be described below with reference to the accompanying drawings.

(Embodiment 1)

An embodiment in which a ring body is constructed is described as follows with reference to FIGS. 1 and 2. In the sequential vibration preventer, a ring body (1) is formed from a soft material that has extendability or viscoelasticity. A plurality of sequential or continuously lined up vibrators (2) are embedded in the interior of this ring body (1), and the inner circumferential surface of the ring body (1) that is caused to contact the ball hitting implement when the ring body (1) is mounted on the ball hitting implement is formed in an arch shape in cross-section.

Here, the plurality of vibrators (2) are disposed in an annular configuration in the radial direction in the interior of the ring body (1) and constitute a single ring or multiple ring configuration.

As is shown in the Figures, the individual adjacent vibrators do not contact each other; but they can be viewed as being regularly disposed in a sequence, and thus they are disposed in a single row (single ring configuration). In the case of a plurality of rows (multiple ring configuration), a tubular ring body is formed, and reference should be made to FIGS. 3 and 4 below.

Here, the disposition of the vibrators (2) does not exclude a configuration in which a number of vibrators are strung together. Of course, the vibrators (2) are not limited to vibrators that are uniform in terms of specific gravity and volume, and the vibrators can also be disposed in an irregular (random) disposition.

Moreover, in cases where the vibrators (2) are formed by linear bodies or belt-form bodies, the vibrators can be disposed in a single row or in a plurality of rows (not shown in the drawings).

Figure 2:
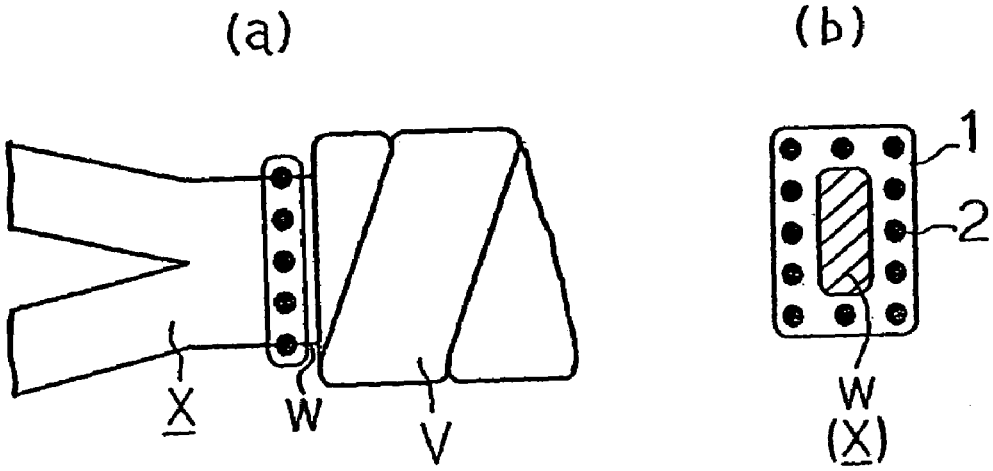
FIG. 2 illustrates an example of use of the same in a tennis racquet, in which (a) is a partial side view explanatory diagram and (b) is a sectional explanatory diagram.

Furthermore, the shape of the ring body (1) can be an annular shape such as that shown in FIG. 1 or a square frame shape such as that shown in FIG. 2; and any configuration that forms a hoop or loop is permissible. The internal diameter of the ring body (1) is set at a value that is slightly smaller than the external diameter of the frame shaft (W) of the racquet (X). The ring body (1) is expanded (spread in diameter), fitted over the frame shaft from the bottom portion of the grip end, moved to a specified position, and mounted (held elastically) on the frame shaft.

Here, since the inner circumferential surface of the ring body (1) is formed in an arch shape as seen in a sectional view, the tight adhesion of the ring body (1) when mounted is improved. More specifically, the ring body (1) is flattened as a result of the expansion (spreading in diameter), so that the inscribed area is expanded, thus causing the elastic recovery force to act toward the inside of the ring body (1). Accordingly, the press-bonding characteristics with respect to the mounting position are reinforced.

Furthermore, a strengthening of the mounting including the prevention of slipping can be accomplished by disposing a two-sided adhesive tape on the inner circumferential surface of the ring body (1) or by forming a recessed portion or groove (not shown in the drawings) in the shaft (W) and accommodating the ring body (1) in this recessed portion or groove.

Figure 7:
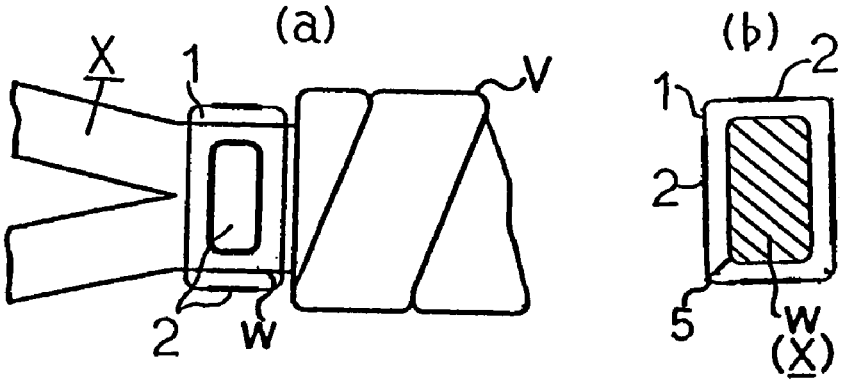
FIG. 7 illustrate an example of use of another embodiment equipped with plate-form vibrators that form a slit-equipped ring body, in which (a) shows a partial side view explanatory diagram and a sectional explanatory diagram (b).

Furthermore, as is shown in FIG. 7 which will be described later, a cut slit (5) can be formed in a portion of the ring body (1), thus constructing the ring body (1) so that this cut slit can be opened; then, following mounting, the joining surfaces of the cut slit (5) are bonded together.

(Embodiment 2)

Another embodiment in which a ring body is constructed will be described with reference to FIGS. 3(*a*) and 4. The sequential vibration preventer is equipped with a wide (tubular) ring body (1), which is formed from a soft material that has extendability or viscoelasticity, and sequentially disposed vibrators (2) in a single ring configuration are sequentially disposed in the interior of this ring body (1) in the axial direction so that a multiple ring configuration is obtained.

Figure 3:
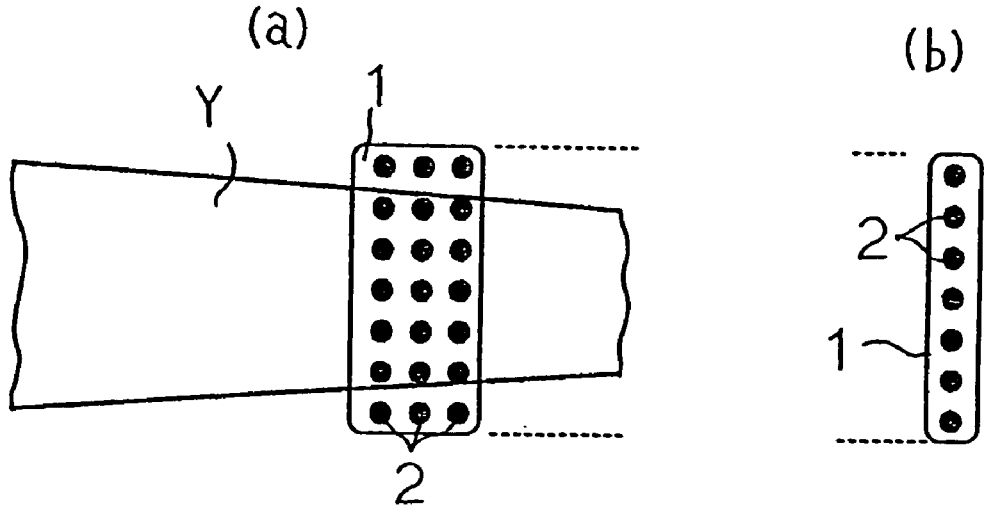
FIG. 3 is a partial side view explanatory diagram illustrating an example of use of the same in a baseball bat, in which (a) shows vibrators with a multiple ring configuration and (b) shows vibrators with a single ring configuration.

FIG. 3(*a*) shows an example of use in the grip (handle portion) of a baseball bat (Y); here, a preventer with a multiple ring configuration is mounted on the front end portion of the grip. Furthermore, one or a plurality of preventers with a single ring configuration may also be mounted as shown in FIG. 3(*b*). Moreover, a case in which the preventer is mounted close to the gripping knob on the grip end is also conceivable (though not shown in the drawings).

Figure 4:
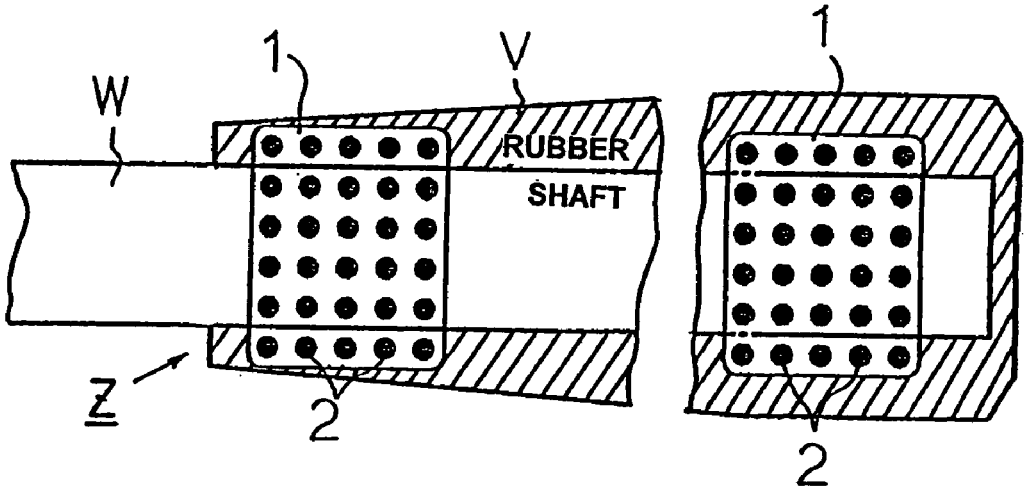
FIG. 4 is a partial side view explanatory diagram illustrating an example of use of the same in a golf club, in which (a) shows the mounting on the front end portion of the grip, and (b) shows the mounting on the rear end of the grip.

FIG. 4 shows an example of use in the grip of a golf club (Z). This Figure illustrates a case in which a bag-form rubber grip (V) that incorporates and integrates two ring bodies (1) is used. In the rubber grip (V) shown in this Figure, recessed portions are formed in the inside surface of a cylindrical member that has a bottom (these recessed portions are formed in two places in the Figure), and the ring bodies (1) are accommodated in these recessed portions, so that the shaft (W) is elastically held. Alternatively, recessed portions (or recessed grooves) are formed in the outer circumference of the shaft (W), and the ring bodies (1) are accommodated in these recessed portions or recessed grooves (vibration control structure described in claim 9 or claim 10). Of course, there may also be use in a configuration in which a ring is fitted over an existing shaft (W) or grip (V) in the same manner as in the case of mounting on a racquet (Embodiment 1).

(Embodiment 3)

An embodiment in which a belt body is constructed will be described with reference to FIGS. 5 and 6. Here, the vibration preventer is equipped with a belt body (1') formed from a soft material that has extendability or viscoelasticity, or a flexible material that is non-extendable. A plurality of vibrators (2) that are sequential or continuously lined up in the direction of length are embedded in the interior of this belt body.

Figure 5:
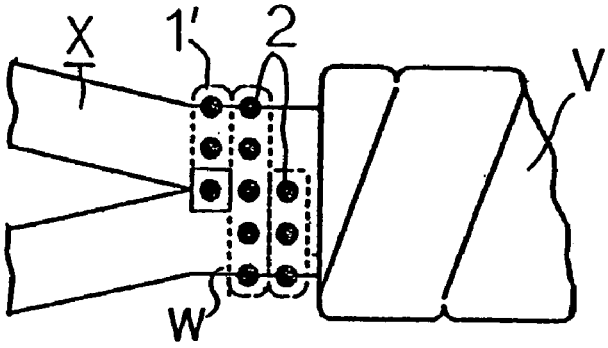
FIG. 5 is a partial side view explanatory diagram illustrating an example of use of an embodiment in which a belt body is formed on the shaft of a tennis racquet.

FIG. 5 shows a case in which the sequential vibration preventer is wrapped in a spiral configuration about the outer circumferential portion of the frame shaft (W) of a racquet (X) and is mounted by means of a two-sided adhesive tape (3).

Figure 6:
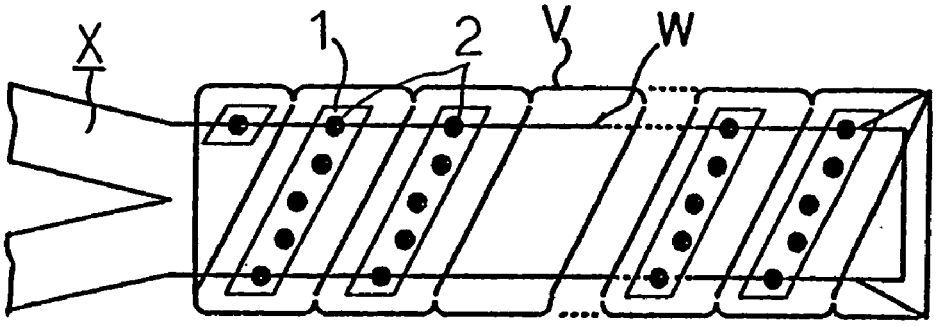
FIG. 6 is a partially cut-away sectional explanatory diagram illustrating an example of use of the same on the grip of a tennis racquet.

FIG. 6 shows a case in which a recessed portion is formed in a spiral configuration in the leather or rubber inner surface of the grip (V) of a racquet (X), or a recessed portion is formed in a spiral configuration in the frame shaft (W) of such a racquet (X), and the belt body (1') is accommodated along this recessed portion.

Figure 8:
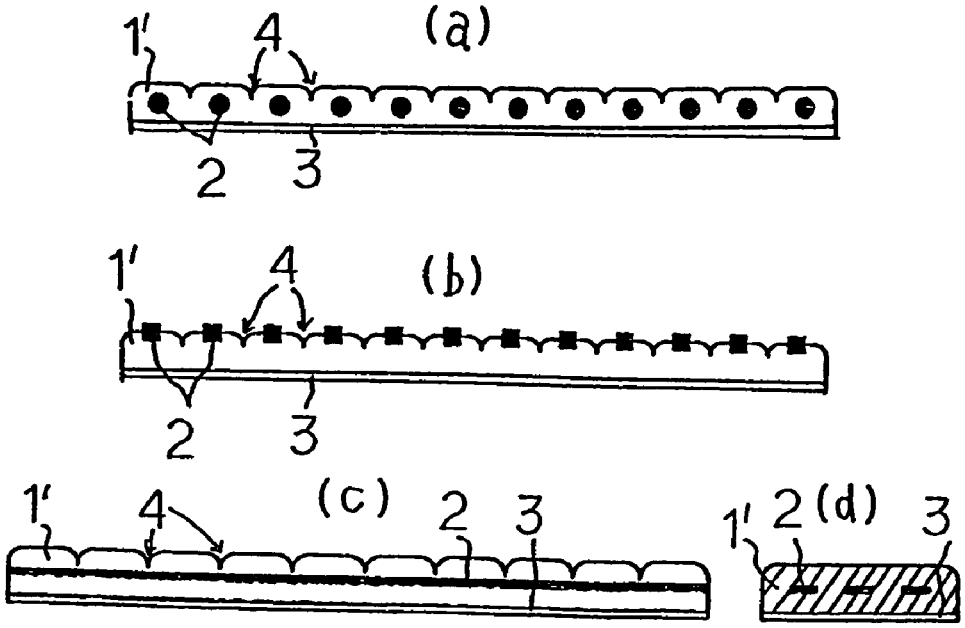
FIG. 8 shows longitudinal sectional explanatory diagrams (a, b, c) of an embodiment in which a belt body equipped with cut grooves is constructed, and a cross-sectional explanatory diagram (d) of FIG. 8(*c*), in which (a) is an embedded installation, (b) is an protruding installation or semi-recessed installation, (c) shows linear or belt-form vibrators, and (d) shows a configuration in which a plurality of rows are installed.
Figure 9:
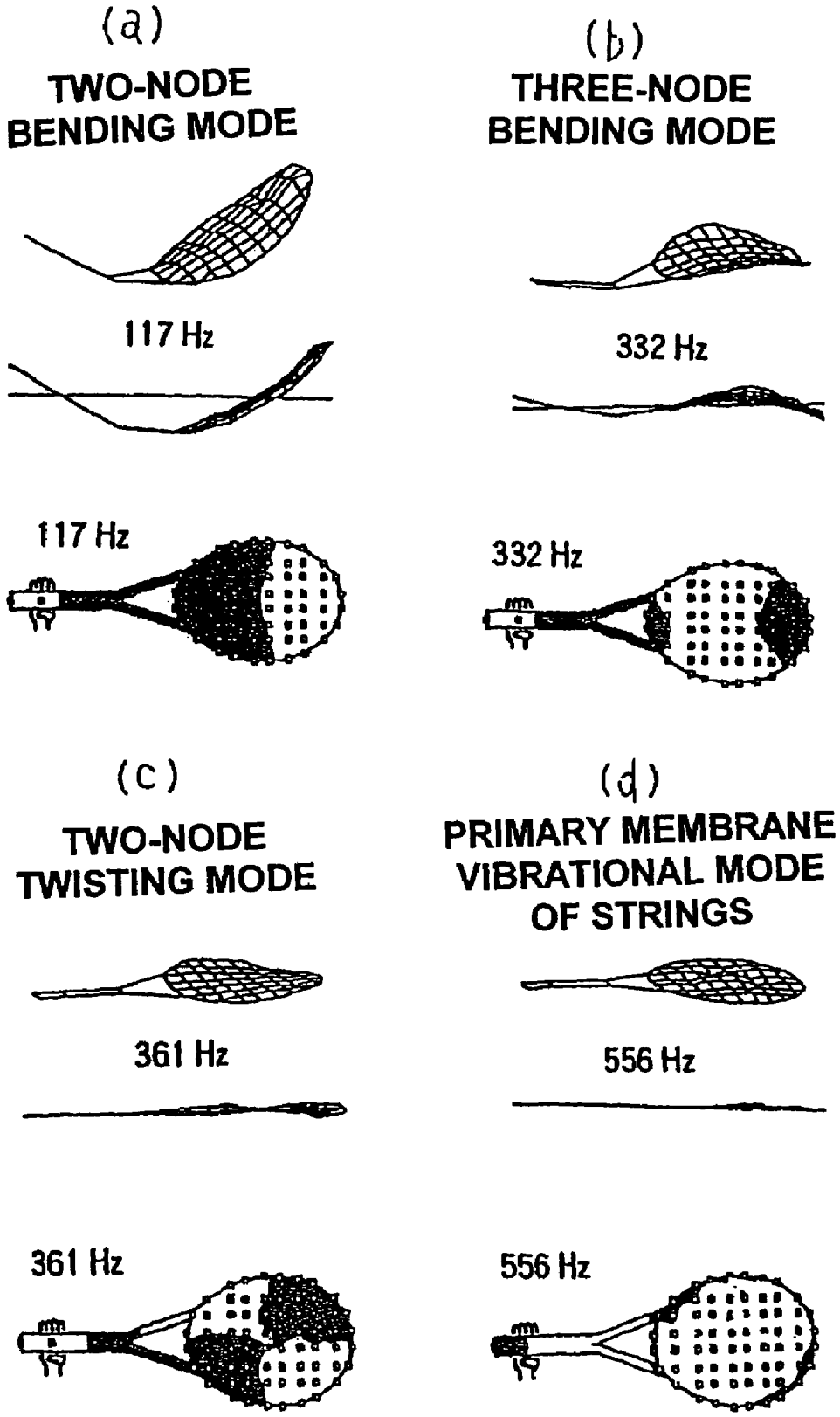
FIG. 9 is an explanatory diagram that shows the respective vibrational modes (a, b, c, d) generated in a racquet.

Here, besides spherical bodies, the vibrators 2 that are used can be circular or square plate bodies (see FIG. 7), linear bodies or belt-form bodies (see FIGS. 8(*c*) and 8(*d*)), etc. Furthermore, the use of a rubber with a high specific gravity as the material of the vibrators 2 can also be considered when these vibrators are used in a ring body (1).

By way of forming cut grooves (4) at predetermined intervals in the surface of the belt body (1') as shown in FIG. 8, the belt body (1') can easily be cut to the length and/or weight required by the user (from a minimum of one vibrator) using these cut grooves as a guide.

The cut grooves (4) are formed by making cut-outs in the cross-sectional direction through the sectional thickness between adjacent vibrators (2) in the surface on at least one side of the belt body (1'), and they are disposed at equal intervals in the direction of length of the belt body. A two-sided adhesive tape (3) is disposed on either the outer surface or inner surface.

In the example shown in the Figures, the cut grooves (4) are formed in a direction perpendicular to the direction of length of the belt body (1'). However, there may also be cases in which the belt body is wrapped in a spiral configuration around the grip of the tennis racquet as shown in FIG. 6; accordingly, the cut grooves (4) can be respectively disposed in an oblique direction.

The vibrators (2) can be disposed in a protruding installation or half-sunken installation on the belt body (1') as shown in FIG. 8(*b*).

Furthermore, in regard to the shape of the vibrators 2, round or square plate bodies (see FIG. 7), linear bodies or belt-form bodies (see FIGS. 8(*c*) and 8(*d*)), etc. can also be appropriately used besides spherical bodies. Moreover, the use of a rubber with a high specific gravity as the material of the vibrators 2 can be also considered when these vibrators are used in a ring body (1).

(Embodiment 4)

Figure 10:
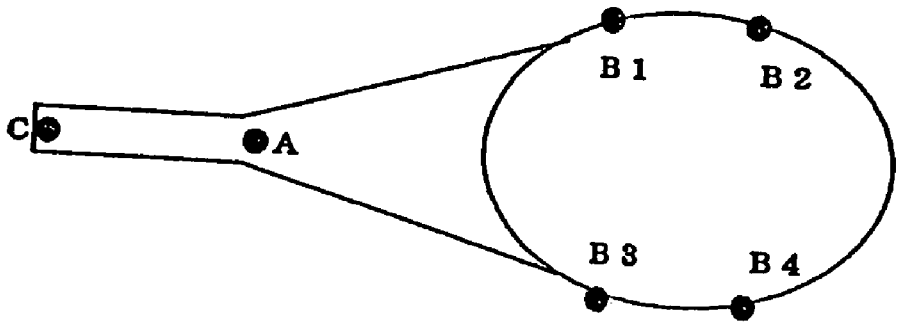
FIG. 10 is an explanatory diagram which shows the positions (A, B1 through B4, C) of "bellies" where the vibration amplitude that is common to the two-node and three-node bending modes generated by the hitting of a ball is large.
Figure 11:
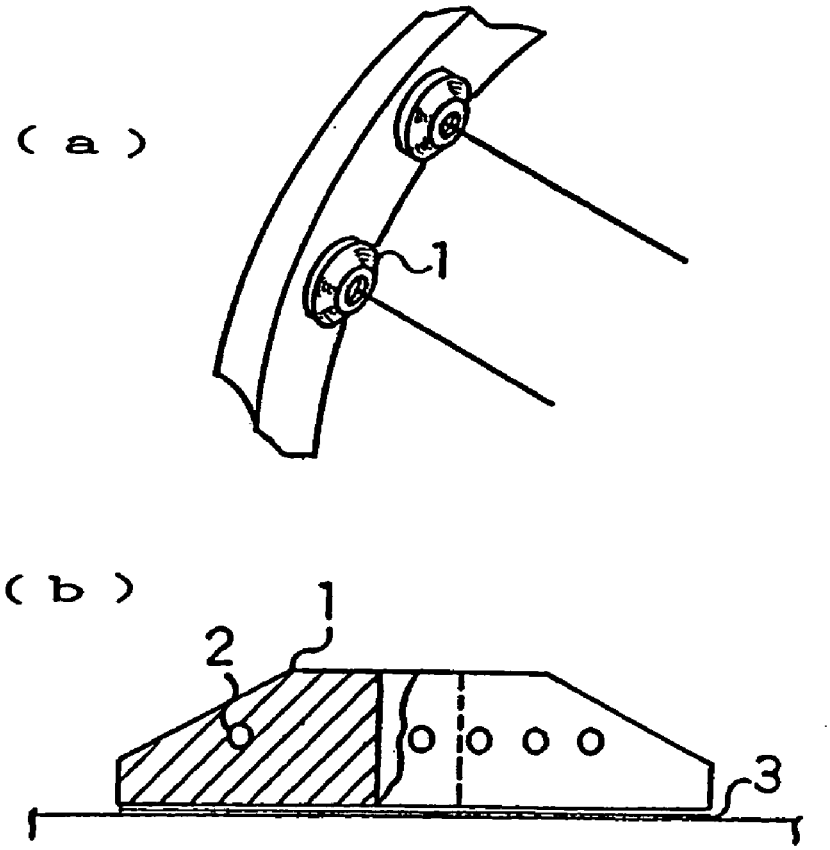
FIG. 11 is an explanatory diagram illustrating an example of use on the inside surface of the frame in the racquet face portions, with mounting on the implement portions B1 through B4 shown in FIG. 10.

Another embodiment in which a ring body is constructed is shown in FIG. 11. Here, ring bodies are mounted on the inside surface of the frame of a racquet face portion. The portions of the implement on which these ring bodies are mounted are B1 through B4 shown in FIG. 10, and they are the portions where the vibration amplitude is large in the racquet face portion. Even more preferably, the inner circumferences of the ring bodies (1) are aligned with the outer circumferential edges of the protruding portions of the grommets, and a two-sided adhesive tape is disposed on the side circumferential surfaces of the ring bodies (1) that contact the frame, so that the ring bodies are mounted in a manner that allows the gut to be strung through both holes. In this case, it is desirable that the shape of the ring bodies (1) resemble the shape of a barnacle (which is a type of shellfish that grows on ship hulls, reefs, etc.). Here as well, the mounting characteristics including the prevention of slipping can be reinforced by forming recessed portions or recessed grooves in the outer circumferential edges of the protruding portions of the grommets, and press-fitting or engaging the ring bodies (1) with these recessed portions either directly ("as is") or with a two-sided adhesive tape interposed.

INDUSTRIAL APPLICABILITY

In the present invention, a structure is adopted in which sequential vibrators (2) are combined and integrated with a ring body (1) or belt body (1') consisting of a soft material that has extendability or viscoelasticity, and the frame shaft (W) and vibrators (2) are separated via this soft material (1, 1') in the mounting positions, so that the impact vibration that occurs when a ball is hit is converted into kinetic energy by the vibration of the sequential vibrators (2) via the soft material at different individual timings. Accordingly, the impact vibration can be effectively attenuated.

Furthermore, a major characterizing feature of the present invention is that since vibrators (2) which are separated (disposed spacedly) are used in a ring body (1) whose material is a soft material that has extendability or viscoelasticity, the vibration preventer is free to undergo extension and contraction or deformation, and mounting of the vibration preventer in conformity to curved shapes in different mounting positions is easily done.

Moreover, the ring body (1) is constructed from a soft material that has extendability, and it can be mounted in specified positions by expanding the ring body; accordingly, the vibration preventer will not be separated by impact form a ball hitting implement.

Furthermore, the mounting characteristics including the prevention of slipping can be enhanced with a two-sided adhesive tape (3) disposed on the inner circumferential surface of the ring body (1) or on either the outer surface or inner surface of the belt body (1').

The ring body (1) or belt body (1') as a whole can be prepared as an easy-to-carry attachment (accessory) and is convenient in that anti-vibration characteristics can easily be provided by a simple mounting operation. Accordingly, the present invention has a high utilization value in the industry.

What is claimed is:

1. A vibration preventer for a ball hitting implement comprising: a belt body (1') consisting of a material selected from the group consisting of a soft material that has extendability or viscoelasticity and a flexible material that is non-extendable; a plurality of vibration dampeners (2) integrated into said belt body (1') by being embedded, contained, sunken, half-sunken or caused to protrude in an interior or on a body surface of said belt body (1') so that the vibration dampeners (2) are lined up in a direction of length of the belt body; cut grooves (4) formed by cut-outs in a cross-sectional direction through a sectional thickness of the belt body (1') in a surface on at least one side of said belt body (1') and lined up at equal intervals in a direction of length of the belt body (1'); and a two-sided adhesive tape (3) disposed on at least one of an outer surface or an inner surface of the belt body (1').

2. The vibration preventer for a ball hitting implement according to claim 1, wherein a plurality of vibration dampeners (2) are disposed in at least a single row in a direction of length of the belt body (1').

3. The vibration preventer for a ball hitting implement according to any one of claims 1, and 2, which is characterized in that the shape of the vibration dampeners (2) is one selected from the group consisting of spheres, circular plates, cubes, rectangular solids, plate bodies, linear bodies and belt-form bodies.

4. A vibration control structure for a ball hitting implement that uses the sequential vibration preventer according to claim 2, wherein said vibration control structure comprises a recess formed in portions of the implement where vibration amplitude is large when a ball is hit; and said vibration preventer of claim 2 is press-fitted or engaged in the recess directly or with a two-sided adhesive tape interposed.

5. A vibration control structure for a grip portion of a ball hitting implement, the vibration control structure comprising the vibration preventer according to claim 2 mounted on a grip portion of a shaft of the ball hitting implement, a covering with a grip made from rubber or leather provided on an outer circumference of the vibration preventer of claim 2, and a recess formed in an outer circumference of said shaft or in an inside surface of the grip, and wherein said vibration preventer is accommodated in said recess.

6. A vibration control structure for a ball hitting implement that uses the sequential vibration preventer according to claim 3, wherein said vibration control structure comprises a recess formed in portions of the implement where vibration amplitude is large when a ball is hit; and said vibration preventer of claim 3 is press-fitted or engaged in the recess directly or with a two-sided adhesive tape interposed.

7. A vibration control structure for a grip portion of a ball hitting implement, the vibration control structure comprising the vibration preventer according to claim 3 mounted on a grip portion of a shaft of the ball hitting implement, a covering with a grip made from rubber or leather provided on an outer circumference of the vibration preventer of claim 3, and a recess formed in an outer circumference of said shaft or in an inside surface of the grip, and wherein said vibration preventer is accommodated in said recess.

8. A vibration control structure for a ball hitting implement that uses the sequential vibration preventer according to claim 1, wherein said vibration control structure comprises: a recess formed in portions of the implement where vibration amplitude is large when a ball is hit; said vibration preventer of claim 1 is press-fitted or engaged in the recess directly or with a two-sided adhesive tape interposed.

9. A vibration control structure for a grip portion of a ball hitting implement, the vibration control structure comprising: the vibration preventer according to claim 1 mounted on a grip portion of a shaft of the ball hitting implement, a covering with a grip made from rubber or leather provided on an outer circumference of the vibration preventer of claim 1, and a recess formed in an outer circumference of said shaft or in an inside surface of the grip, and wherein said vibration preventer is accommodated in said recess.

* * * * *